US010934126B2

(12) United States Patent
Hefele

(10) Patent No.: US 10,934,126 B2
(45) Date of Patent: Mar. 2, 2021

(54) TEXTILE MACHINE ASSEMBLY COMPRISING A SLIVER STORAGE UNIT FOR THE INTERIM STORAGE OF SLIVER

(71) Applicant: Maschinenfabrik Rieter AG, Winterthur (CH)

(72) Inventor: Josef Hefele, Pfaffenhofen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 100 days.

(21) Appl. No.: 16/163,939

(22) Filed: Oct. 18, 2018

(65) Prior Publication Data

US 2019/0119833 A1 Apr. 25, 2019

(30) Foreign Application Priority Data

Oct. 20, 2017 (DE) ..... 10 2017 124 562.6

(51) Int. Cl.

| | |
|---|---|
| ***B65H 51/20*** | (2006.01) |
| ***D01G 21/00*** | (2006.01) |
| ***B65H 57/14*** | (2006.01) |
| ***D01H 5/00*** | (2006.01) |

(52) U.S. Cl.

CPC ..... *B65H 51/20* (2013.01); *B65H 57/14* (2013.01); *D01G 21/00* (2013.01); *D01H 5/005* (2013.01); *B65H 2701/311* (2013.01)

(58) Field of Classification Search

CPC ..... B65H 51/20; D01G 21/00; D01G 15/02; D01H 5/00; D01H 13/00; D01H 13/10

See application file for complete search history.

(56) References Cited

U.S. PATENT DOCUMENTS

| | | | |
|---|---|---|---|
| 3,345,702 | A | 10/1967 | Hermann et al. |
| 3,852,848 | A | 12/1974 | Feller |
| 3,891,155 | A | 6/1975 | Naegeli |
| 6,375,112 | B1 | 4/2002 | Engelhardt |
| 7,458,236 | B2 | 12/2008 | Kinder et al. |

(Continued)

FOREIGN PATENT DOCUMENTS

| | | | |
|---|---|---|---|
| DE | 28 45 881 | A1 | 4/1980 |
| DE | 32 27 979 | A1 | 3/1983 |
| DE | 35 34 846 | A1 | 4/1987 |

(Continued)

OTHER PUBLICATIONS

EP Office Action, dated Mar. 6, 2020.

*Primary Examiner* — William E Dondero
(74) *Attorney, Agent, or Firm* — Dority & Manning, P.A.

(57) ABSTRACT

A textile machine assembly includes a delivery unit and a receiving unit, wherein during operation of the textile machine assembly the delivery unit delivers a sliver to the receiving unit. A sliver storage unit is operatively configured between the delivery unit and the receiving unit to store, at least intermittently, excess sliver between the delivery unit and the receiving unit when a delivery speed of the sliver at the delivery unit is higher than a receiving speed of the sliver at the receiving unit, and to release the stored sliver when the receiving speed of the sliver at the receiving unit is higher than the delivery speed of the sliver at the delivery unit. The sliver storage unit includes a diverting unit that is movable with respect to the delivery unit or the receiving unit, wherein movement of the diverting unit changes a sliver path of the sliver from the delivery unit to the receiving unit.

13 Claims, 4 Drawing Sheets

(56) References Cited

U.S. PATENT DOCUMENTS

2006/0225465 A1 10/2006 Kinder et al.

FOREIGN PATENT DOCUMENTS

| | | | |
|---|---|---|---|
| DE | 199 15 529 | A1 | 10/2000 |
| DE | 10 2005 008 705 | B3 | 9/2006 |
| DE | 10 2005 037 836 | A1 | 2/2007 |
| DE | 10 2010 063 466 | A1 | 6/2012 |
| DE | 10 2012 218 178 | A1 | 11/2013 |
| DE | 10 2015 119 143 | A1 | 5/2017 |
| EP | 1 695 934 | A2 | 8/2006 |
| GB | 2 105 375 | A | 3/1983 |
| JP | 2009 030180 | A | 2/2009 |
| WO | WO 98/32903 | | 7/1998 |
| WO | WO 2017/076577 | A1 | 5/2017 |

TEXTILE MACHINE ASSEMBLY COMPRISING A SLIVER STORAGE UNIT FOR THE INTERIM STORAGE OF SLIVER

FIELD OF THE INVENTION

The present invention relates to a textile machine assembly comprising a delivery unit, in particular, a card, with the aid of which a sliver is delivered during the operation of the delivery unit, and a receiving unit, in particular, a drafting frame, with the aid of which the sliver delivered by the delivery unit is received during the operation of the receiving unit. Moreover, the textile machine assembly includes at least one sliver storage unit which stores, at least intermittently, the excess sliver between the delivery unit and the receiving unit for the interim when a delivery speed of the sliver at the delivery unit is higher than a receiving speed of the sliver at the receiving unit, and which releases the sliver stored for the interim when a receiving speed of the sliver at the receiving unit is higher than the delivery speed of the sliver at the delivery unit. Moreover, the invention relates to textile machines for delivering and receiving sliver, wherein each textile machine comprises a sliver storage unit for the interim storage of the sliver. The invention also relates to a method for operating the textile machine assembly.

BACKGROUND

WO 2017/076577 A1 describes a device for transporting a sliver. The device comprises an associated input section, output section, and guide section for each sliver to be transported. The guide section includes an associated drive section which is configured for grasping the sliver to be transported at at least one point. The guide section is furthermore designed for accommodating the sliver coming from the input section in the direction of the output section via a length which is greater than a distance between the drive section and the output section. The disadvantage thereof is that the sliver can be accommodated only by way of a loop being formed, whereby the sliver can become knotted and damaged, for example, especially when the loops are large.

SUMMARY OF THE INVENTION

A problem addressed by the present invention is therefore that of eliminating the disadvantage of the related art. Additional objects and advantages of the invention will be set forth in part in the following description, or may be obvious from the description, or may be learned through practice of the invention.

The problems are solved by a textile machine assembly, textile machines, and a method for the interim storage of a sliver on a textile machine and/or a textile machine assembly having the features set forth herein.

The invention relates to a textile machine assembly having a delivery unit, with the aid of which a sliver is delivered during the operation of the delivery unit. The delivery unit can be a card, for example, which produces or provides a sliver. The delivery unit can also be another unit of the textile machine assembly, however, which processes a sliver, provides a sliver for a subsequent working step, and/or merely forwards a sliver.

The textile machine assembly furthermore includes a receiving unit, with the aid of which the sliver delivered by the delivery unit is received during the operation of the receiving unit. The receiving unit is therefore positioned downstream from the delivery unit. The receiving unit can be, for example, a drafting frame which drafts and, therefore, further processes the sliver delivered by the delivery unit. The receiving unit can also be any unit of the textile machine assembly, however, which receives a sliver for further processing or merely forwards a sliver for further processing.

During normal operation of the textile machine assembly, the sliver can be continuously delivered by the delivery unit and can be continuously received by the receiving unit.

The textile machine assembly also comprises at least one sliver storage unit, with the aid of which the sliver can be stored for the interim, at least intermittently. The sliver storage unit stores the sliver, for example, when a delivery speed of the sliver at the delivery unit is higher than a receiving speed of the sliver at the receiving unit. The delivery unit therefore delivers the sliver faster than the receiving unit can receive, accommodate, further process, and/or forward the sliver. Due to the fact that the sliver can be stored for the interim, the delivery speed of the delivery unit does not need to be adjusted at all, or needs to be only slightly adjusted, for example. The delivery unit does not need to be stopped, for example, in order to give the receiving unit time to receive the excess sliver.

Likewise, the sliver storage unit can also release the sliver which has been stored for the interim when the receiving speed of the sliver at the receiving unit is higher than the delivery speed of the sliver at the delivery unit. As a result, the case can be compensated for, in which the receiving unit forwards and/or further processes the sliver faster than the delivery unit can deliver or provide the sliver. Moreover, as a result, the sliver storage unit in which the sliver is stored for the interim can be emptied again. The sliver storage unit can therefore also be utilized as an intermediate buffer for sliver.

According to the invention, the sliver storage unit includes at least one diverting unit which is movable with respect to the delivery unit and can divert the sliver. Additionally or alternatively, the diverting unit can also be movable with respect to the receiving unit. The sliver can be diverted with the aid of the diverting unit. A sliver path for the sliver from the delivery unit to the receiving unit can be changed with the aid of the diverting unit. In this case, the sliver path can be the path which the sliver must follow from the delivery unit to the receiving unit when the sliver is tightened to a maximum extent. The sliver path can be, for example, a shortest, i.e., most direct, path between an exit point of the sliver at the delivery unit and an entry point of the sliver at the receiving unit (in this case, a possible sagging of the sliver, which also contributes to the sliver path, of course, is not to be taken into account at first). This type of shortest path can be, for example, 2 m.

The diverting unit can be moved, for example, in such a way that the sliver path from the delivery unit to the receiving unit lengthens. The diverting unit can be moved, for example, in such a way that the sliver must follow an alternate path from the delivery unit to the receiving unit. The sliver must therefore cover a longer distance from the delivery unit in order to reach the receiving unit. As a result, a longer sliver section is situated between the delivery unit and the receiving unit. The sliver path can be lengthened from the 2 m described above by way of example to 3 m, for example, and so 1 m of sliver can be stored for the interim.

The sliver path can be shortened again in order to enable the excess sliver between the delivery unit and the receiving unit to be released again. For this purpose, the diverting unit can be moved in the direction counter to the direction for lengthening the sliver path. As a result, an additional sliver section can be released. The excess sliver can be accommodated by the receiving unit which can receive the sliver faster than the delivery unit can deliver the sliver. As a result, the speed difference between the receiving unit and the delivery unit can be compensated for.

In one advantageous refinement of the invention, at least one sliver storage unit is situated at the delivery unit. Additionally or alternatively, at least one sliver storage unit can also be situated at the receiving unit. Additionally or alternatively as well, a sliver storage unit can also be situated in an area between the delivery unit and the receiving unit. As a result, the sliver path can be adjusted in a targeted manner.

It is advantageous when the diverting unit is movable in a first direction along the gravity direction. Gravity causes the sliver to sag and form a loop when the delivery unit delivers sliver faster than the receiving unit can receive the sliver. When the loop is large enough, the sliver lies on a base between the delivery unit and the receiving unit, wherein the sliver becomes contaminated or damaged and can become knotted. The diverting unit can be moved, for example, against the force of gravity, i.e., upward away from the base, and so the sliver can be diverted away from the base. In this way, the sliver can be prevented from touching the floor. In addition, a particularly large amount of sliver can be stored for the interim by moving the diverting unit upward.

It is also advantageous when the diverting unit is movable in a second direction perpendicularly to the gravity direction and in parallel along a connecting axis between the delivery unit and the receiving unit. As a result, the diverting unit can be moved, for example, back and forth between the delivery unit. As a result, sliver can be stored for the interim when there is not much space available in the surroundings of the textile machine assembly. The textile machine assembly can therefore be designed to be space-efficient.

It can also be advantageous when the diverting unit is movable in a third direction perpendicularly to the gravity direction and perpendicularly to the connecting axis. Therefore, the diverting unit can be moved transversely between the delivery unit and the receiving unit. As a result, the sliver can be laterally deflected.

It is advantageous when the diverting unit is movable in such a way that the first, the second, and/or the third directions are superimposed. As a result, the diverting unit can be moved arbitrarily in space. If, for example, a further movement of the diverting unit in a first direction, for example, upward, is no longer possible, the diverting unit can be moved, for example, in the third direction. As a result, a flexibility of the movement of the diverting unit is increased.

It is advantageous when the diverting unit can be moved by a distance which corresponds to at least 50% of the distance between the delivery unit and the receiving unit. The distance by which the diverting unit can be moved can also correspond to at least 100% of the distance between the delivery unit and the receiving unit. As a result, a sufficient amount of sliver can be stored for the interim, in order to compensate for a temporary difference between the delivery speed and the receiving speed.

It is advantageous when the at least one sliver storage unit comprises an actuator, with the aid of which the diverting unit can be moved. As a result, the diverting unit can be moved in an automated manner.

Moreover, it is advantageous when the actuator comprises a hydraulic actuator, a pneumatic actuator, an electric motor, a stepper motor and/or a servo motor.

Additionally or alternatively, it is advantageous when the diverting unit is situated on an extension which can be moved with the aid of the actuator. Additionally or alternatively, the extension can also be capable of swiveling, and so the diverting unit can be swiveled. The extension can also be a telescopic rod, and so the sliver storage unit can be designed to be compact while the diverting unit can nevertheless be moved a great distance.

It is advantageous when the diverting unit comprises a roller. The sliver can run over the roller. As a result, the sliver can be well diverted. The roller can also be driven with the aid of a drive, and so the roller actively forwards the sliver.

Moreover, it is advantageous when the textile machine assembly comprises a controller which is connected to the delivery unit for the purpose of exchanging data. Additionally or alternatively, the controller can also be connected to the receiving unit for the purpose of exchanging data. For example, the controller can receive the delivery speed of the delivery unit and/or the receiving speed of the receiving unit. Additionally or alternatively, the controller can receive a point in time of an impending can change. For example, in connection with a can change at the receiving unit designed as a drafting frame, the controller can ascertain how the diverting unit must be moved in order to store sliver for the interim in order to compensate for a reduction in the receiving speed. The controller can also throttle or stop the receiving speed in this case.

Moreover, a textile machine is provided, which can be a card, for example. The textile machine comprises a delivery unit, with the aid of which a sliver is delivered during the operation of the delivery unit. In addition, the textile machine comprises at least one sliver storage unit which stores, at least intermittently, the excess sliver between the delivery unit and the receiving unit for the interim when a delivery speed of the sliver at the delivery unit is higher than a receiving speed of the sliver at a receiving unit of a further textile machine. The sliver can be released from the sliver storage unit when a receiving speed of the sliver at the receiving unit is higher than the delivery speed of the sliver at the delivery unit.

According to the invention, the sliver storage unit comprises at least one diverting unit which can be moved with respect to the delivery unit, with the aid of which the sliver can be diverted, and with the aid of which a sliver path for the sliver from the delivery unit to the receiving unit can be changed.

In this case, the sliver storage unit can preferably comprise one or several features according to the preceding and/or the following descriptions.

Moreover, the textile machine which comprises the delivery unit and the further textile machine which comprises the receiving unit can form the above-described textile machine assembly.

Moreover, a textile machine is provided, which can be a drafting frame, for example. The textile machine comprises a receiving unit, with the aid of which a sliver is received during the operation of the receiving unit. In addition, the textile machine comprises at least one sliver storage unit which stores, at least intermittently, the excess sliver between the delivery unit and the receiving unit for the interim when a receiving speed of the sliver at the receiving unit is lower than a delivery speed of the sliver at a delivery unit of a further textile machine. The further textile machine can be a card, for example. The sliver storage unit can also release the sliver which has been stored for the interim when a receiving speed of the sliver at the receiving unit is higher than the delivery speed of the sliver at the delivery unit.

According to the invention, the sliver storage unit includes at least one diverting unit which can be moved with respect to the receiving unit, with the aid of which the sliver can be diverted, and with the aid of which a sliver path for the sliver from the delivery unit to the receiving unit can be changed.

In this case, the sliver storage unit can preferably include one or several features according to the preceding and/or the following descriptions.

Moreover, the textile machine which comprises the receiving unit and the further textile machine which comprises the delivery unit can form the above-described textile machine assembly.

The invention further relates to a method for the interim storage of a sliver on a textile machine assembly. The textile machine assembly can be designed according to at least one feature of the preceding and/or the following descriptions.

The textile machine assembly comprises a delivery unit, with the aid of which a sliver is delivered during the operation of the delivery unit. The delivery unit can be a card, for example, which delivers a sliver. The delivery unit can also be another unit of the textile machine assembly, however. The delivery unit provides the sliver.

The textile machine assembly furthermore comprises a receiving unit, with the aid of which the sliver delivered by the delivery unit is received during the operation of the receiving unit. The receiving unit can be, for example, a drafting frame. The receiving unit can also be another unit of the textile machine assembly, however. The receiving unit receives the sliver, for example, in order to forward and/or process the sliver.

In addition, the textile machine assembly comprises a sliver storage unit which stores, at least intermittently, the excess sliver between the delivery unit and the receiving unit for the interim when a delivery speed of the sliver at the delivery unit is higher than a receiving speed of the sliver at the receiving unit.

The sliver storage unit can also release the sliver which has been stored for the interim when a receiving speed of the sliver at the receiving unit is higher than the delivery speed of the sliver at the delivery unit.

According to the invention, the sliver storage unit comprises at least one diverting unit which is movable with respect to the delivery unit, with the aid of which the sliver can be at least intermittently diverted. Additionally or alternatively, the diverting unit can also be moved with respect to the receiving unit. With the aid of the diverting unit, a sliver path for the sliver from the delivery unit to the receiving unit is changed when sliver is to be stored for the interim or is to be released again.

The sliver path can be the path that the sliver must cover from the delivery unit to the receiving unit. The sliver path can be, for example, the shortest path, i.e., the direct path, from the delivery unit to the receiving unit. With the aid of the diverting unit, this sliver path is, for example, lengthened when sliver is to be stored for the interim. As a result, the sliver must follow an alternate path from the delivery unit to the receiving unit. Therefore, a larger sliver piece is situated between the delivery unit and the receiving unit, and so the excess sliver is stored for the interim.

For example, the direct path from the delivery unit to the receiving unit is 2 m. The diverting unit is now moved, and so the sliver path is lengthened. The sliver must now follow a path from the delivery unit to the receiving unit which is 3 m. The difference of 1 m sliver is stored for the interim.

If the diverting unit moves back again, the sliver path is 2 m again, for example. The additional 1 m is released again. The excess 1 m of sliver can be accommodated by the receiving unit when the receiving unit receives the sliver faster than the delivery unit delivers the sliver.

In one advantageous refinement of the invention, if sliver is sagging, the diverting unit is moved, and so the sliver path is lengthened. The diverting unit can be moved upward, for example, counter to the sagging sliver. As a result, the sliver is advantageously lifted off of a base, and so the sliver does not lie on the base.

It is also advantageous when the diverting unit is moved in such a way that a loop forming as a result of the sagging sliver is reduced in size. As a result, the sliver is guided away from the base, and so the greater distance between the sliver and the base can be available again for the interim storage of the sliver. Additionally or alternatively, the diverting unit can also be moved in such a way that the loop maintains a constant size.

It is advantageous when the diverting unit is moved in such a way that the sliver path is shortened in order to release the sliver which has been stored for the interim. The diverting unit can be moved, for example, counter to the direction in which the diverting unit was moved in order to lengthen the sliver path. The diverting unit can be moved back into a starting position.

BRIEF DESCRIPTION OF THE DRAWINGS

Further advantages of the invention are described in the following exemplary embodiments. Wherein.

DETAILED DESCRIPTION

Figure 1:
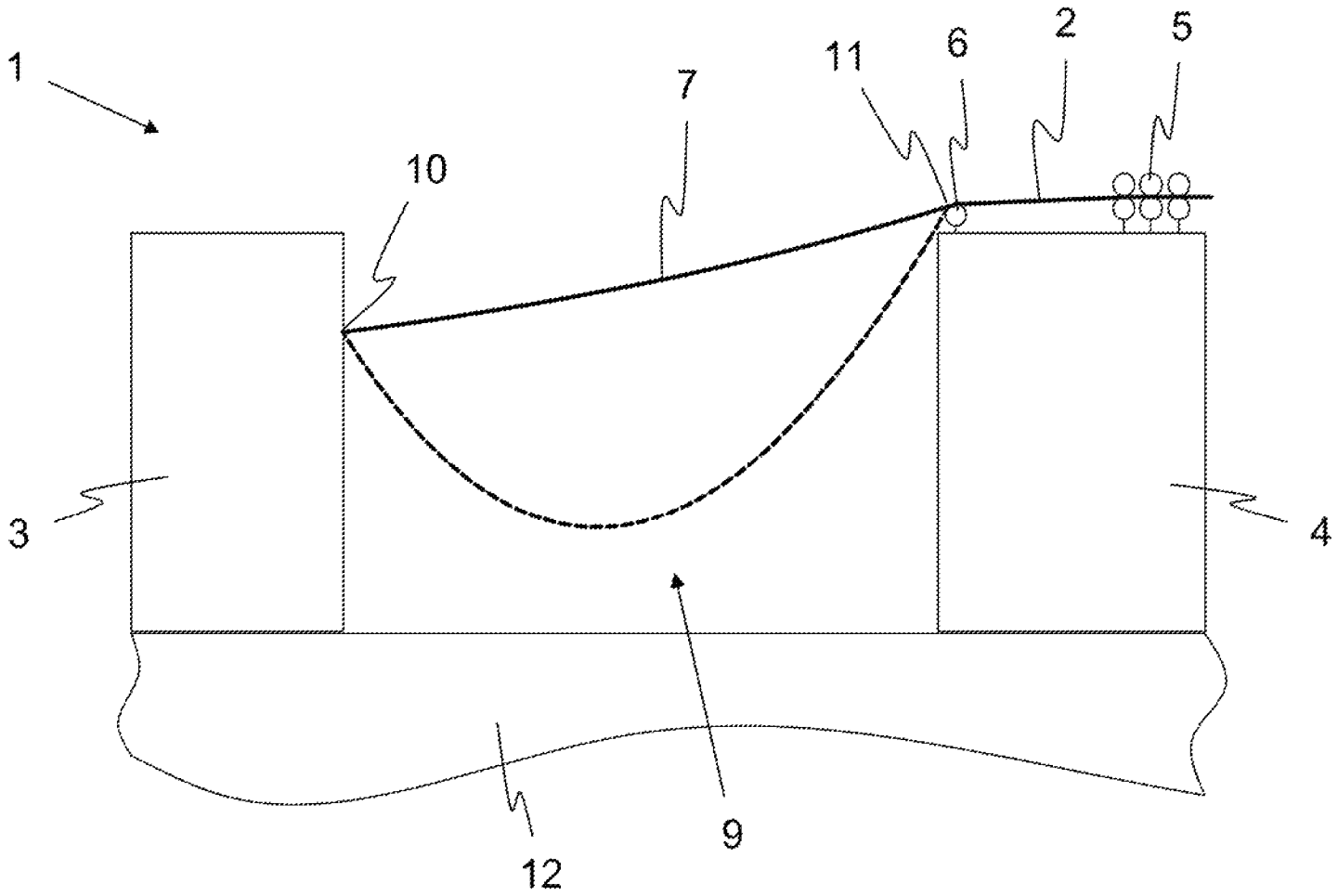
FIG. 1 shows a schematic view of a textile machine assembly comprising a delivery unit, a receiving unit, and a sliver.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a textile machine assembly 1 comprising a delivery unit 3 and a receiving unit 4.

A sliver 2 is delivered with the aid of the delivery unit 3 during the operation of the textile machine assembly 1. The delivery unit 3 can be a card, for example, which can card the textile fibers. The delivery unit 3 can also be another unit, however, which provides the sliver 2. The delivery unit 3 can deliver the sliver 2 with a delivery speed during operation.

The delivery speed can be, for example, 10 m/min. Therefore, 10 m sliver per minute are delivered by the delivery unit 3.

The sliver 2 delivered by the delivery unit 3 is received with the aid of the receiving unit 4 during the operation of the textile machine assembly 1. According to the present exemplary embodiment, the receiving unit 4 is a drafting frame which comprises a drafting system 5. The receiving unit 4 can also be another unit, however, which receives the sliver 2. According to the present exemplary embodiment, the receiving unit 4 can comprise an entry roller 6, with the aid of which the sliver 2 can be guided into the receiving unit 4. The receiving unit 4 can have a receiving speed at which the receiving unit 4 receives the sliver 2. Advantageously, the delivery speed of the delivery unit 3 and the receiving speed of the receiving unit 4 are equal. As a result, on the one hand, the sliver 2 is prevented from tearing. On the other hand, this prevents the sliver 2 from being placed on a base 12 between the delivery unit 3 and the receiving unit 4, wherein the sliver 2 can become dirty and damaged in this way.

If the delivery speed and the receiving speed are equal, the sliver 2 can have a first sliver path 7. The first sliver path 7 can be a direct path between an exit point 10 of the sliver 2 at the delivery unit 3 and an entry point 11 of the sliver 2 at the receiving unit 4. In this case, the sliver 2 has the first sliver path 7. This can represent a normal operation of the textile machine assembly 1.

If the receiving unit 4 is a drafting frame 4, for example, a can (not shown here) can be positioned downstream from the drafting frame 4, in which the sliver 2 drafted by the drafting frame 4 is placed. The can becomes completely filled after a certain amount of time, and a can change is necessary. For this purpose, the receiving unit 4 must be briefly stopped or at least briefly decelerated in terms of a processing speed. This means, the receiving unit 4 can only more slowly receive the sliver 2 or, if stopped, the receiving unit 4 cannot receive sliver 2 at all. The receiving speed of the receiving unit 4 is lower than the receiving speed during normal operation. When the delivery unit 3 delivers the sliver 2 at an unchanged delivery speed, however, and the delivery speed is therefore higher than the receiving speed, a sliver loop 9, which is represented as a dashed line, forms between the delivery unit 3 and the receiving unit 4, according to FIG. 1. If the sliver loop 9 becomes larger than shown in FIG. 1, the sliver 2 will eventually land on the base 12, which can be disadvantageous, as described above.

Figure 2:
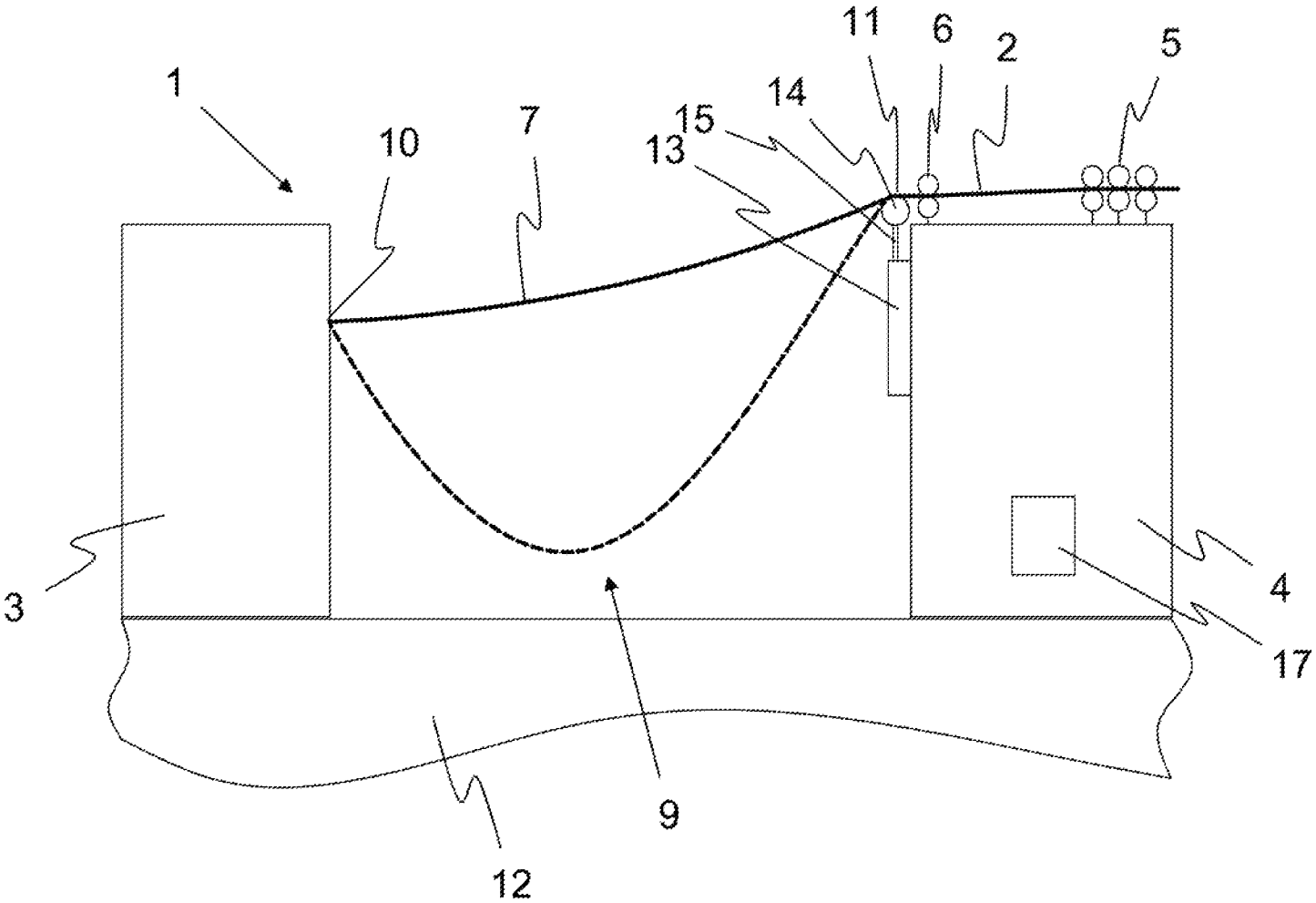
FIG. 2 shows a schematic view of a textile machine assembly comprising a delivery unit, a receiving unit, a sliver, and a sliver storage unit comprising a diverting unit.

According to FIG. 2, the textile machine assembly 1 can comprise a sliver storage unit 13 which includes a diverting unit 14. The sliver 2 can be diverted with the aid of the diverting unit 14. The sliver path for the sliver 2 from the delivery unit 3 to the receiving unit 4 can also be changed with the aid of the diverting unit 14. In this exemplary embodiment, the sliver storage unit 13 comprising the diverting unit 14 is situated at the receiving unit 4. Additionally or alternatively, the sliver storage unit 13 can also be situated at the delivery unit 3. Additionally or alternatively as well, a sliver storage unit 13 can also be situated in an area between the delivery unit 3 and the receiving unit 4. For example, the sliver storage unit 13 can stand on the base 12.

The sliver storage unit 13 comprises an extension 15, at the end of which the diverting unit 14 is situated. The sliver storage unit 13 can comprise an actuator (not shown here), with the aid of which the extension 15 can be moved, and so the diverting unit 14 can be moved. The actuator can be, for example, a hydraulic actuator, a pneumatic actuator, an electric motor, and/or a stepper motor, wherein the actuator can be controlled with the aid of a controller 17 in order to move the diverting unit 14. The extension 15 can be, for example, a telescopic rod, and so the diverting unit 14 can be moved even further.

The textile machine assembly 1 can furthermore comprise the controller 17 which can move the diverting unit 14. The controller 17 can receive, for example, information from the delivery unit 3 and/or from the receiving unit 4. For example, the controller 17 can receive the delivery speed of the sliver 2 at the delivery unit 3. Additionally or alternatively, the controller 17 can also receive the receiving speed of the sliver 2 at the receiving unit 4. The controller 17 can calculate, for example, the difference on the basis thereof. On the basis thereof, the controller 17 can calculate how much sliver 2 is to be stored for the interim. The controller 17 can correspondingly move the diverting unit 14.

Figure 3:
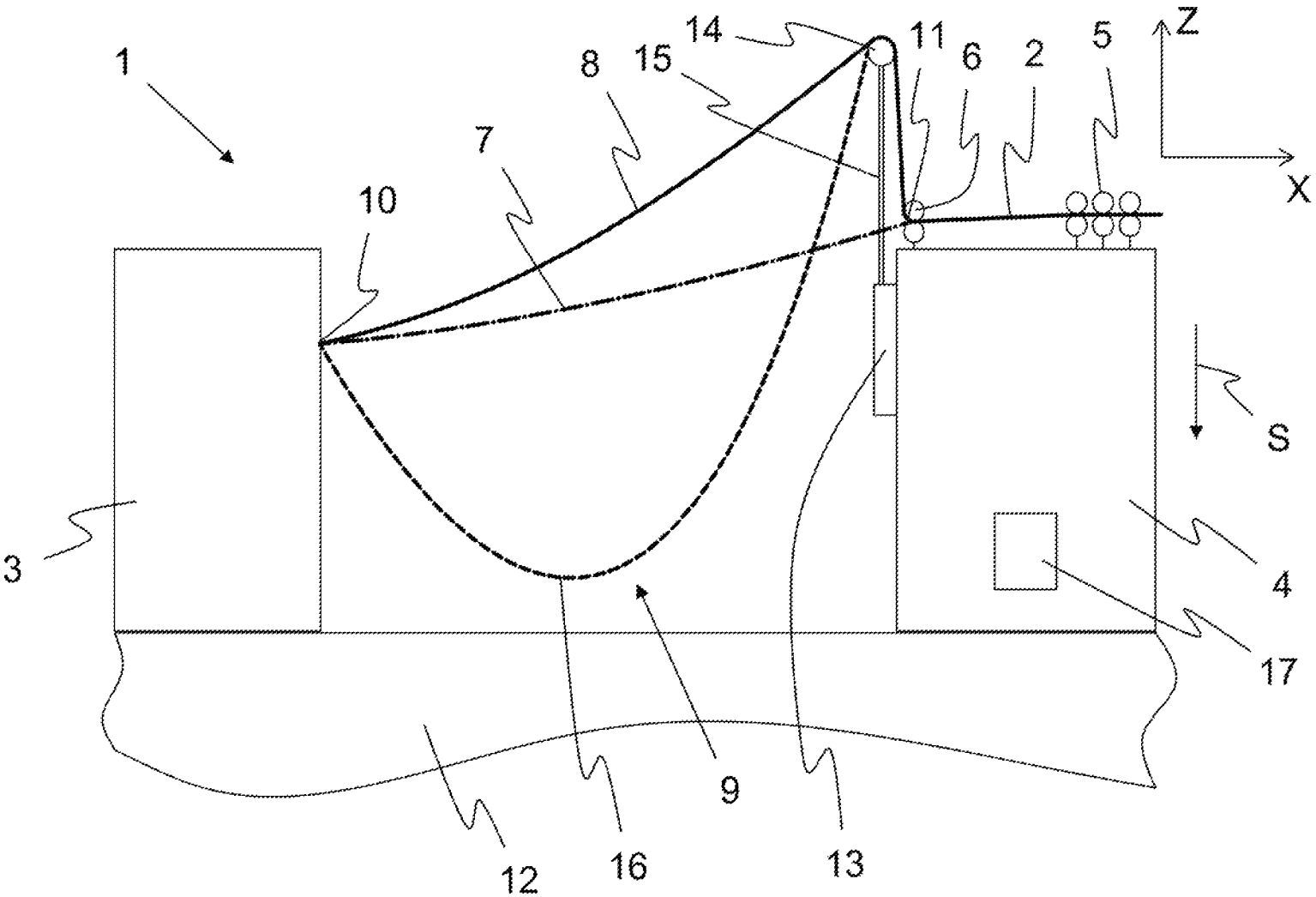
FIG. 3 shows a schematic view of a textile machine assembly comprising a delivery unit, a receiving unit, a sliver, and a sliver storage unit comprising a moved diverting unit.

FIG. 3 shows a textile machine assembly 1 comprising the delivery unit 3, the receiving unit 4, and comprising a moved diverting unit 14. The diverting unit 14 has been moved along a first direction Z. The first direction Z is oriented in parallel to a gravity direction S. The gravity along the gravity direction S pulls the sliver 2 downward into the loop 9 in the direction of the base 12. The diverting unit 14 has been moved further counter to the gravity direction S along the first direction Z.

The first sliver path 7 according to FIG. 1 or 2 is now indicated with the aid of a dash-dotted line. The first sliver path 7 is, for example, 2 m. Since the diverting unit 14 has moved, the sliver path has also changed. The sliver 2 must now follow a second sliver path 8 in order to reach the receiving unit 4. The second sliver path 8 is an alternate path as compared to the first sliver path 7, and so the second sliver path 8 is longer than the first sliver path 7. The sliver 2 now must extend from the exit point 10 and over the diverting unit 14 in order to reach the entry point 11. The second sliver path 8 has a length, for example, which is 2.5 m. A difference between the second and the first sliver paths 7, 8 is 0.5 m, and so this length of sliver 2 is stored for the interim.

The diverting unit 14 can be moved, for example, in the first direction Z counter to the gravity force S at a point in time when the receiving speed at the receiving unit 4 drops below the delivery speed at the delivery unit 3. The sliver 2 is therefore drawn upward at the same time as when more sliver 2 is delivered by the delivery unit 3 than can be accommodated by the receiving unit 4. This case occurs, for example, when the receiving unit 4 is a drafting frame and a can change is started.

The diverting unit 14 can also first move in the first direction Z counter to the gravity direction S when the loop 9 has formed. Only when the loop 9 according to the exemplary embodiment from FIG. 2 has formed, for example, can the diverting unit 14 be moved in the first direction Z counter to the force of gravity and, therefore, away from the base 12. According to FIG. 3, the sliver 2 then has a third sliver path 16. In contrast to the second sliver path 8, more sliver 2 is stored for the interim with the aid of the loop 9. The third sliver path 16, which extends from the exit point 10 through the loop 9 and over the diverting unit 14 to the entry point 11, can have, for example, a length of 3.5 m. The first sliver path 7 is 2 m, and so, in contrast thereto, 1.5 m of sliver 2 is stored for the interim. In this type of arrangement of the sliver 2 according to the third sliver path 16, it is therefore possible for 1.5 m of sliver 2 to be stored for the interim when the sliver 2 was situated along the first sliver path 7 at the beginning. When the delivery speed is, for example, 10 m/min, and the receiving unit 4 is completely stopped, for example, for a can change, it takes 9 seconds for 1.5 m of sliver 2 to be stored for the interim. This means, the can change can last for 9 s until the receiving unit 4 must be restarted in order to receive the sliver 2 again.

When the sliver 2 is to be released again, the diverting unit 14 can be moved back into the starting position. According to FIG. 3, the diverting unit 14 is moved in the first direction Z in the direction of the base 12. The release can then take place, for example, when the can change has been concluded. The receiving unit 4 can receive the sliver 2 faster than the delivery unit 3 delivers the sliver 2, for a short period of time. As a result, the excess sliver 2 is guided into the receiving unit 4. For example, the diverting unit 14 can be moved back into the starting position only when the loop 9 has receded. The sliver 2 then no longer extends along the third sliver path 16. Instead, the sliver 16 extends along the second sliver path 8. Only then can the diverting unit 14 be moved. Alternatively, the diverting unit 14 can also be moved in such a way that the loop 9 recedes and, simultaneously, the diverting unit 14 is moved.

Figure 4:
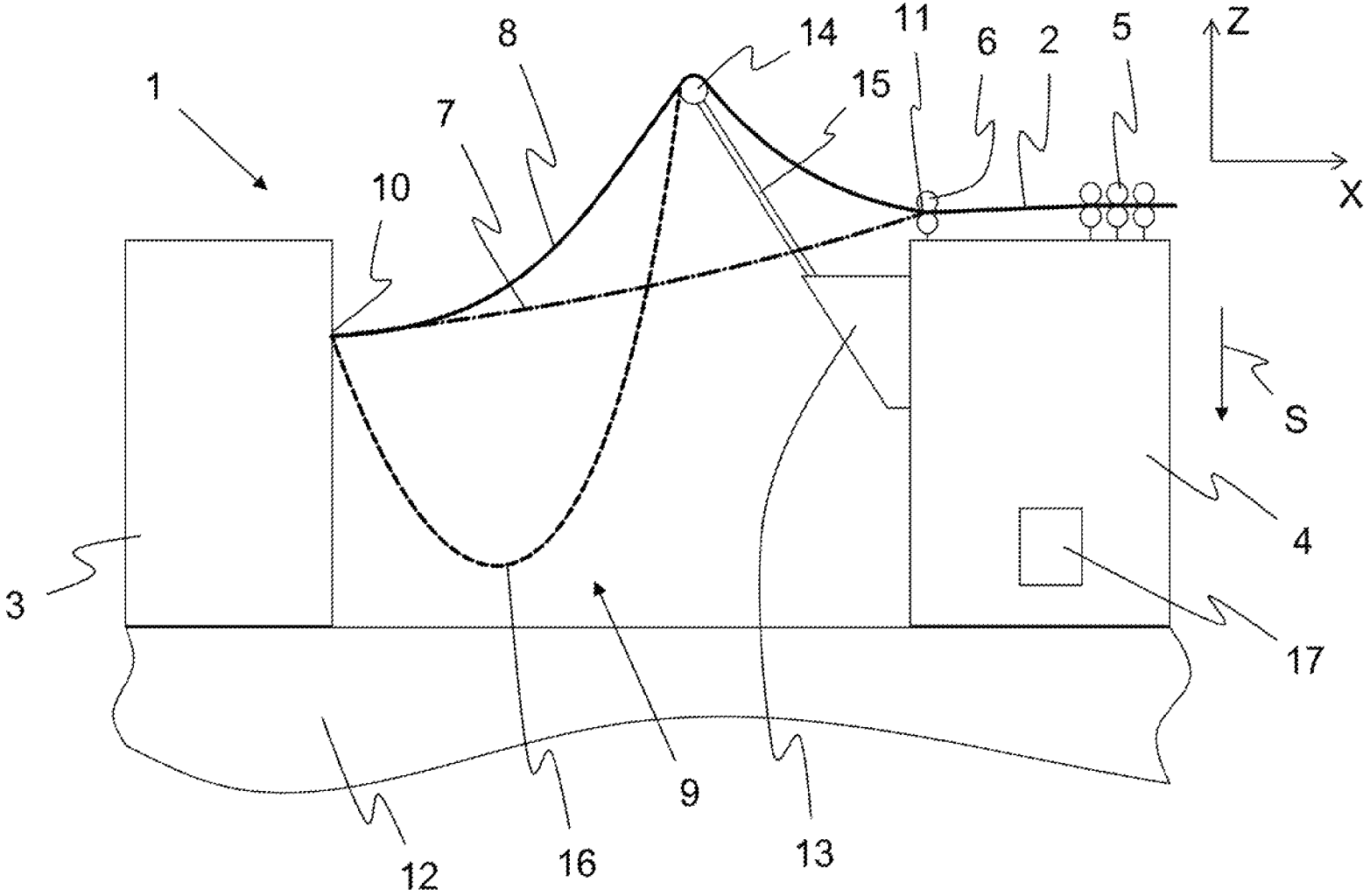
FIG. 4 shows a schematic view of a textile machine assembly comprising a delivery unit, a receiving unit, a sliver, and a sliver storage unit comprising a moved diverting unit.

FIG. 4 shows a schematic view of a textile machine assembly 1 comprising a delivery unit 3, a receiving unit, and a moved diverting unit 14. In this exemplary embodiment, the diverting unit 14 can be moved in a second direction X in addition to the first direction Z. The second direction X is oriented along a connecting axis between the delivery unit 3 and the receiving unit 4. Due to the second direction X, the diverting unit 14 can therefore be moved in the direction of the delivery unit 3 and/or in the direction of the receiving unit 4. According to the exemplary embodiment represented in FIG. 4, the movement of the diverting unit 14 in the first direction Z and in the second direction X are superimposed. The diverting unit 14 can therefore also be moved at a slant.

Additionally or alternatively, the diverting unit 14 can also be moved along a third direction Y which is not shown here, however. In this side view of the textile machine assembly 1, the third direction Y is oriented out of or into the plane of the drawing. The diverting unit 14 can therefore be moved laterally along the third direction Y.

The present invention is not limited to the exemplary embodiments which have been represented and described. Modifications within the scope of the claims are also possible, as is any combination of the features, even if they are represented and described in different exemplary embodiments.

LIST OF REFERENCE SIGNS

1 textile machine assembly
2 sliver
3 delivery unit
4 receiving unit
5 drafting system
6 entry roller
7 first sliver path
8 second sliver path
9 loop
10 exit point
11 entry point
12 base
13 sliver storage unit
14 diverting unit
15 extension
16 third sliver path
17 controller
Z first direction
X second direction
Y third direction
S gravity direction

The invention claimed is:

1. A textile machine assembly, comprising:
a delivery unit comprising a card machine;
a receiving unit comprising a drafting frame, wherein during operation of the textile machine assembly the card machine delivers a sliver to the drafting frame;
a sliver storage unit operatively configured between the card machine and the drafting frame to store, at least intermittently, excess sliver between the card machine and drafting frame when a delivery speed of the sliver at the card machine is higher than a receiving speed of the sliver at the drafting frame, and to release the stored sliver when the receiving speed of the sliver at the drafting frame is higher than the delivery speed of the sliver at the card machine;
the sliver storage unit comprising a diverting unit that is movable with respect to the card machine or the drafting frame, wherein movement of the diverting unit changes a sliver path of the sliver from the card machine to the drafting frame; and
wherein to increase storage, the diverting unit is movable in a first upward direction (Z) counter to a gravity direction (S) to lift the sliver such that a hanging loop formed in the sliver between the carding machine and the diverting unit increases in size.

2. The textile machine assembly as in claim 1, wherein the sliver storage unit is situated at the card machine or at the drafting frame.

3. The textile machine assembly as in claim 1, wherein the diverting unit is movable in a second direction (X) perpendicular to the first direction (Z) and in parallel to a connecting axis between the card machine and the drafting frame to allow an additional loop to form in the sliver between the diverting loop and the drafting frame.

4. The textile machine assembly as in claim 3, wherein the diverting unit is movable in a third direction (Y) perpendicular to the first direction (Z) and perpendicular to the connecting axis between the card machine and the drafting frame.

5. The textile machine assembly as in claim 4, wherein the diverting unit is movable in such a way that the first, the second, and the third directions (Z, X, Y) are superimposed.

6. The textile machine assembly as in claim 1, wherein the diverting unit is movable by a distance corresponding to at least 50% of a distance between the card machine and the drafting frame.

7. The textile machine assembly as in claim 1, further comprising an actuator configured with the sliver storage unit to move the diverting unit.

8. The textile machine assembly as in claim 7, wherein the actuator comprises one of a hydraulic actuator, a pneumatic actuator, an electric motor, a stepper motor, or a servo motor, and the diverting unit is situated on an extension configured with the actuator.

9. The textile machine assembly as in claim 1, further comprising a controller connected to one or both of the card machine and the drafting frame and to the sliver storage unit.

10. A method for the interim storage of a sliver at a textile machine assembly in accordance with claim 1, comprising storing, at least intermittently, the excess sliver in a growing loop between the card machine and the drafting frame when the delivery speed of the sliver at the card machine is higher than a receiving speed of the sliver at the drafting frame, and releasing the stored sliver when the receiving speed of the sliver at the drafting frame is higher than the delivery speed of the sliver at the card machine, wherein for the storing and the releasing of the sliver, the sliver path of the sliver between the card machine and the drafting frame is changed with the diverting unit to allow for the loop to increase in size.

11. The method as in claim 10, wherein the diverting unit is moved to length the sliver path is the sliver is sagging in the sliver path.

12. The method as in claim 11, wherein the diverting unit is moved in such a way that a loop forming in the sliver as a result of the sagging sliver is reduced in size or maintains a constant size.

13. The method as in claim 10, wherein the diverting unit is moved so as to shorten the sliver path in order to release the stored sliver.

* * * * *